US005873356A

United States Patent [19]

Vossler et al.

[11] Patent Number: 5,873,356

[45] Date of Patent: Feb. 23, 1999

[54] HIGH EFFICIENCY WOOD PELLET STOVE

[75] Inventors: Jeffrey L. Vossler, Morrison; Walter K. Tomooka, Littleton, both of Colo.

[73] Assignee: Control Options, Inc., Englewood, Colo.

[21] Appl. No.: 494,813

[22] Filed: Jun. 26, 1995

[51] Int. Cl.[6] ..... F24H 3/00

[52] U.S. Cl. ..... 126/110 E; 126/112; 126/502; 126/522; 110/203; 110/211

[58] Field of Search ..... 126/110 E, 112, 126/77, 61, 83, 502, 522, 66; 110/211, 203

[56] References Cited

U.S. PATENT DOCUMENTS

| | | | |
|---|---|---|---|
| 4,351,315 | 9/1982 | Babbage | 126/73 |
| 4,438,756 | 3/1984 | Chamberlain et al. . | |
| 4,545,360 | 10/1985 | Smith et al. | 126/76 |
| 4,585,161 | 4/1986 | Kusama et al. | 236/15 BD |
| 4,922,889 | 5/1990 | Nuesmeyer et al. | 126/73 |
| 5,001,993 | 3/1991 | Gramlow | 110/233 |
| 5,014,680 | 5/1991 | Siemer | 126/77 |
| 5,144,941 | 9/1992 | Saito et al. | 126/507 |
| 5,152,309 | 10/1992 | Twerdochlib et al. | 137/8 |
| 5,183,028 | 2/1993 | Traeger et al. | 431/125 X |

*Primary Examiner*—Larry Jones

*Attorney, Agent, or Firm*—Edwin H. Crabtree; Ramon L. Pizarro; Donald W. Margolis

[57] ABSTRACT

A wood pellet stove for efficiently burning wood pellets and especially burning pellets at low burns. The stove is accurately controlled by a control panel with a microprocessor which helps safely regulate air flow from a combustion air and exhaust gas fan. Also, the microprocessor helps control convection air flow from a convection air fan and regulate feed of wood pellets into a burn pot using a motorized auger. The microprocessor is further used to monitor inlet air temperature and exhaust gas temperature. The stove includes a stove housing with a fire box and a fire box access door in the front of the housing. The burn pot includes a burn grate and pit used for receiving and burning wood pellets. The burn pot is disposed on a fire box floor. A wood pellet hopper is disposed in the rear of the housing for holding wood pellets therein. The motorized auger is used for feeding the wood pellets into the burn pot. The stove is characterized by having heat exchanger panels with dimpled surfaces which can easily be removed for cleaning. The dimpled panels are attached to the fire box walls with a space therebetween for forming air and exhaust gas channels. Combustion air and exhaust gases are circulated from the fire box, using an exhaust fan, up a front side of the panels and into the air and exhaust gas channels behind the panels for effectively extracting generated heat from the air and exhaust gases.

17 Claims, 11 Drawing Sheets

HIGH EFFICIENCY WOOD PELLET STOVE

FIELD OF THE INVENTION

This invention relates to the provision of apparatus for and a method of efficiently burning fuel pellets in a microprocessor controlled pellet stove and, in particular, for a low carbon monoxide burner system with removable high heat exchanger panel plates and improved convection air flow.

BACKGROUND OF THE INVENTION

Wood burning stoves, fireplaces, etc., pose a significant environment problem. ("*Burning permits possible . . . Senate OKs bill relying first on voluntary efforts to cut wood smoke in area by half by* 1995." Sanko J., Rocky Mountain News, Apr. 9, 1991.) There are hundreds of designs and configurations of stoves and fireplaces, and all are operated, more or less, for their esthetics and warmth. Some systems burn the fuel more efficiently than others with respect to heat output and still others with respect to pollution. This is particularly true with pellet stoves.

A pellet stove uses a compressed wood product manufactured from, for example saw dust and wood chips, etc., a waste product from the lumber industry. These pellets, sized in an extruded tubular shape nugget about ¼ inch diameter and ⅝ inch long, provide an economical, renewable fuel source. As wood burning stoves or fireplaces go, the certified pellet burning stove is certainly the more efficient.

The problem is, that even these existing certified pellet stoves are not as friendly to the environment as they could be. Many of the currently available pellet stoves have heat exchange systems to make the system to be more efficient and a burner to reduce the carbon monoxide output. But they are still polluting and there is still room to more efficiently extract heat from the pellet fuel combustion.

It is necessary that the pellet stove apparatus be extremely sensitive in a burn cycle and, in particular, in a "low" burn where the pellet fuel is subject to high carbon monoxide levels in the exhaust gas. It is extremely difficult to keep the flame hot enough to maintain efficient low carbon monoxide levels, yet at a low fuel consumption rate. This would require a system that had a means to control even the smallest combustion flame maintaining an exact temperature, and a means to extract the greatest ratio possible from the heat generated to be called "overall" a high efficacy system. It is important to understand that all existing pellet fuel stoves are manually adjusted. That is, they are set to a "level" of operation by the user and the stove functions to that preset regardless of the ever changing prevailing conditions, e.g., wind changing pressures on air inlet and exhaust outlet, ambient room temperatures, exhaust gas temperatures, etc. These systems do not continuously adjust for the varying conditions and the result is a hit or miss as to efficiency and it is impossible for these system to achieve continuous clean burning.

It may therefore be seen that it is a problem in the art to provide a heating stove that can operate both at low burn, with low emissions and, have a high heat exchange ratio that is environmentally acceptable and still pleasingly esthetic.

DISCUSSION OF THE PRIOR ART

The patents discussed in the following numbered paragraphs relate to pellet stoves and were uncovered during a prior art search prior to filing the present application.

1. U.S. Pat. No. 5,123,360 to Burke et al. of Jun. 23, 1992 teaches an enhanced air circulation arrangement and a "push-pull" system effect which improves the draft and flow of air through the combustion chamber to include a means for pressurizing a fuel storage area.

2. U.S. Pat. No. 5,133,266 to Cullen of Oct. 17, 1992 discloses an arrangement which permits combustion air to flow into the combustion chamber solely by natural convection.

3. U.S. Pat. No. 5,137,010 to Whitfield of Aug. 11, 1992 discloses a combustion grate having movable elongated blades designed to prevent ash accumulating and reducing the flow of combustion gas into the fire.

4. U.S. Pat. No. 5,137,012 to Crossman of Aug. 11, 1992 teaches an arrangement of a pellet burner having an elongated combustion zone with a feed system of a thin layer of combustible pellets. The stove incorporates an artificial log set.

5. U.S. Pat. No. 5,151,000 to Geraghty of Sep. 29, 1992 discloses a hopper system for fuel pellets which feeds horizontally to the firebox.

6. U.S. Pat. No. 5,285,738 to Cullen of Feb. 15, 1994 uses an arrangement which permits combustion air to flow into the combustion chamber solely by natural convection. The stove system has several apertures, a shaker heat sink and a drop chute.

7. U.S. Pat. No. 5,295,474 to Whitfield et al. of Mar. 22, 1994 discloses an arrangement in which a plurality of rods in a grate system prevents unburned bio-mass pellets from accumulating on grate in amounts that could reduce the flow of combustion gas into the fire.

8. U.S. Pat. No. 5,331,943 to Hsiung of Jul. 26, 1994 discloses an arrangement using a tube made from heat-resistant and transparent glass, a seat member burning means and pillars. There is a cleaning means with three scrape members.

It can be seen from the above that a number of the arrangements have been proposed for efficiently burning fuel pellets in a heating stove. While all of the above discussed arrangement may be suitable for the purposes for which they were conceived, they all suffer from one or more disadvantages with regard to the goal of overall efficiency and, in particular, efficacy at "low" burn levels. Overall efficiency being, again defined as: low combustion, low emissions, high heat exchange ratio. In fact several of the arrangement, numbered paragraphs 3, 4, 6, 7 and 8 all have some means to deal with "an accumulation of ash that could block" combustion air flow. A clear sign that the device is not efficiently operating. Others, numbered paragraphs 2 and 6, have arrangements which permits combustion air to flow into the combustion chamber solely by natural convection to achieve high combustion efficiency and clean burning. This is an oxymoron! Efficient burning must be explicitly controlled to achieve clean burning through the dynamic range of fuel available.

Still, none of the above discussed arrangements, while possibly being suitable for the purpose for which they were originally conceived, are capable of burning clean at relatively small fuel amounts at low burns. A requirement in todays compliance with newly enacted pollution laws, rules and regulations with which today's industry must comply. And none have optional humidifier water tanks giving humidified air capability to the unit.

It can therefore be seen that it is a problem to provide apparatus that can accurately burn pellet fuel at low burn rates which have low exhaust gas emissions. It is also a problem to provide apparatus that is high in heat exchange in combination with the said low burn efficacy. The low carbon monoxide high efficacy pellet stove of the present invention addresses all the issues above listed and will provide efficient low cost, controlled heat while meeting and exceeding the standards of emissions pollution as are enacted or may be pending.

SUMMARY OF THE INVENTION

The present invention overcomes the above discussed disadvantages and achieves an advance in the art by providing improved apparatus for accurately controlling combustion, especially at low burns. The provided apparatus has low emissions of carbon monoxide in the exhaust gas and consequently is, by definition, highly efficient in pellet fuel combustion. The provided apparatus can effectively extract generated heat at said low burns through a unique heat exchange system incorporating dimpled surfaces in exhaust gas and convection air passages and channels. The efficient heat exchange system in combination with the accurate control of fuel combustion makes the pellet fuel heating stove of the present invention, an overall highly efficient apparatus providing an economical, clean and environmentally friendly system.

The invention is further advantageous in that the provided apparatus has removable panel plate heat exchangers, requiring no nuts, bolts or screws to remove, allowing ease in cleaning and maintenance. Said removable panel plates are constructed of stainless steel and are safe to handle as opposed to the hazardous ceramic firebricks found in other pellet stoves. The present invention further incorporates novel water storage tanks, positioned directly behind the fire box and under the influence of residual radiated heat, providing a means of evaporation resulting in humidified air as an optional feature to the heating stove. Said humidified air is vented by appropriate louvered vents on the top of the apparatus with other vents on the side allowing the free flow of ambient air and making the control areas of the device cool in its operation.

All aspects of the provided apparatus are controlled by a microprocessor to include the sensitive flow of combustion air, the exhaust gas temperature, the inlet air temperature, the convection air flow, the pellet fuel feed, the remotely mounted thermostat, the user preferred preset settings and, a tone generator signaling device for operating feedback to the user. The precise operations of these features make the difference between a stove system which simply burns fuel, and a highly overall efficient pellet fuel heating plant which is easy to use, clean and is friendly to the environment. These and other objects of the present invention will become apparent to those skilled in the art from the following detailed description, showing the contemplated novel construction, combination, and elements as herein described, and more particularly defined by the appended claims.

It may be from the above that the Applicant's invention provides a new and novel method of efficiently burning pellet fuel in a heating stove that overcomes many of the disadvantages of the above discussed prior art arrangements and achieves a technical advance in the art. It being understood, that changes in the precise embodiment to the herein disclosed invention are meant to be included as coming within the scope of claims, except insofar as they may be precluded by the prior art.

DETAILED DESCRIPTION OF THE INVENTION

Figure 1:
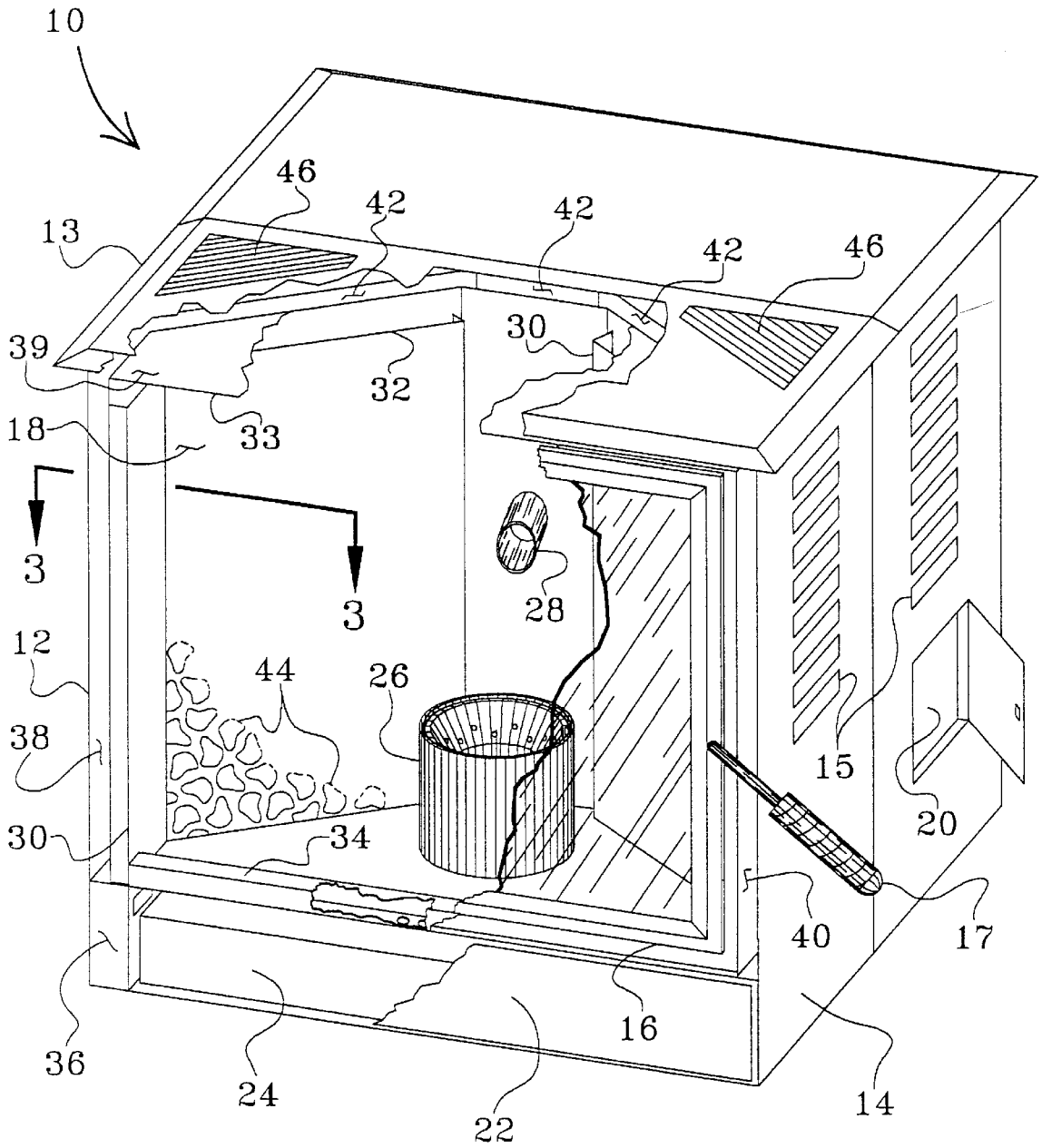
FIG. 1 sets forth a perspective view of a the high efficient pellet stove system shown in a cutaway featuring its unique heat exchange components and low burn, low emissions burn pot.

FIG. 1 discloses a pellet fuel heating stove apparatus 10 comprising one possible illustrative embodiment of the present invention having louvered side panels 12 and 14, and a beveled top 13 being shown in a partial cutaway revealing internal structure. A louvered vent 15 is on each of the side panels 12 and 14 which allows residual heat build-up to ventilate out of the apparatus 10. There is a glass door 16 with a door handle 17 providing a sealed fire box 18 enclosure. On the right side panel 14 is a control panel 20. Further shown on FIG. 1 is a ash pan access door 22 and behind it, an ash pan 24. There is a burn pot 26 and an auger drop tube 28 within the fire box 18. The main interior walls of the fire box 18 adjoin a fire box top 33 and has a removable inner panel plate heat exchanger 30 on each side of the burn pot 26. A top edge 32 of the removable inner panel plate heat exchangers 30 are lower than the fire box top 33 by, for example, one inch. Additional structure is an ash direction tube 34 and, an exhaust gas evacuation channel 36.

There is a left convection air outlet 38 and a right convection air outlet 40 the full length of the sides of the apparatus 10 between the fire box 18 and the outer panels 12 and 14 respectively. Across the top of the fire box is also a top convection air outlet 39 (not detailed in FIG. 1 because of the cutaway) which extends the full length from side to side. A convection air channel 42 completely surrounds the walls of the fire box 18 on the back, sides and top, and are connected to the convection air outlets 38, 39 and 40 respectively. The sides and top surfaces of the fire box 18 have a dimpled texture 44, making an irregular surface to them comprised of bumps extending outwardly from the surface as much as, in the preferred embodiment, ⅜ of an inch. The reverse side of a ⅜ inch dimple protrusion would be an indentation. The dimpled texture 44 surfaces comprise the heat exchange system and shall be more fully discussed later in this disclosure. The top panel 13 has a louvered humidifier vent 46 disposed on each side behind the centrally located fire box.

It should be noticed in connection with FIG. 1 in the preferred embodiment, that the pellet stove apparatus 10 of the present invention is formed in a 2 foot square comprised of stainless steel through in and through out. The outer panels forming the skin, may be coated with a high temperature paint product to enhance the esthetic appeal. Although the preferred embodiment is intended to be placed on a pedestal (not shown), it may as easily be place on an existing fire place hearth opening fitted with appropriate "skirting" material surrounding the sides and top.

Figure 2:
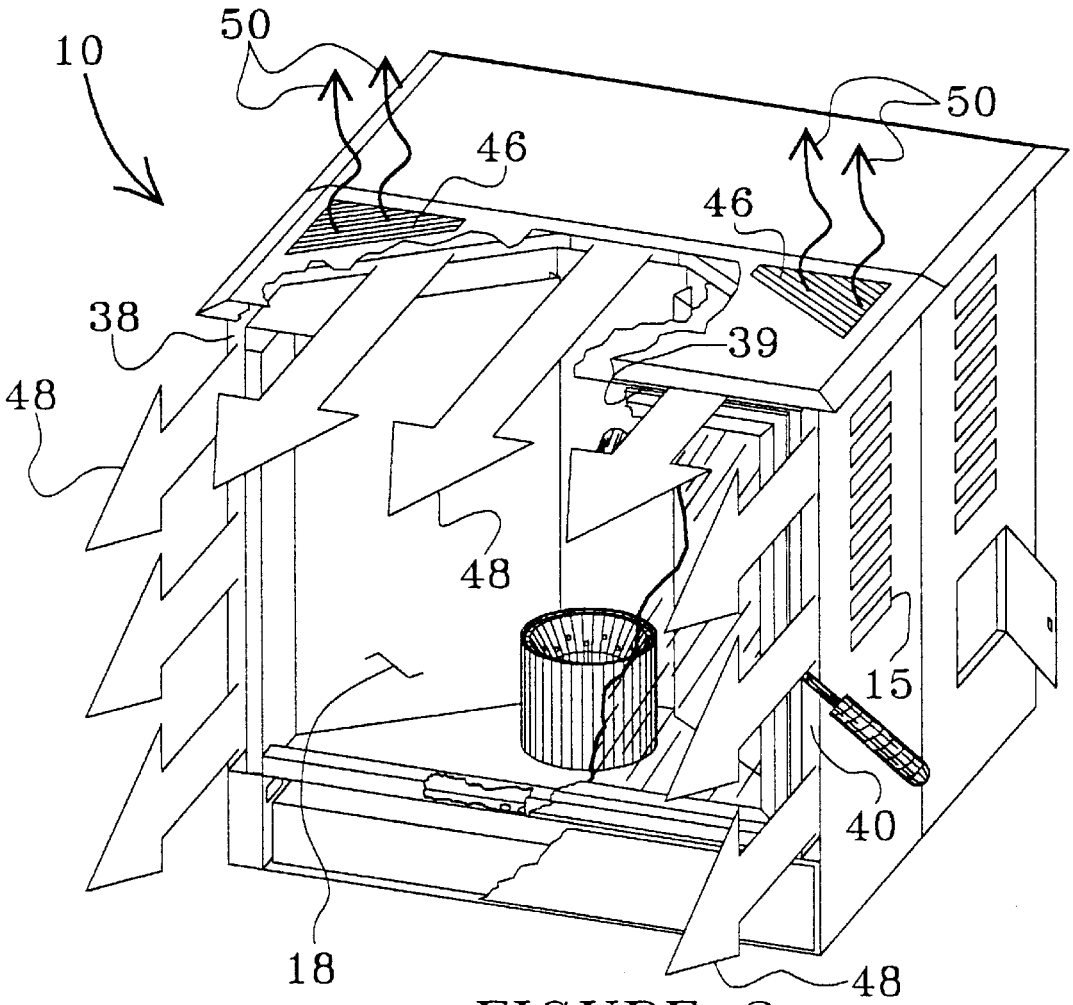
FIG. 2 is another perspective illustration showing the convection air flow which surrounds the fire box channeling air through the heat exchange system.

In FIG. 2 is shown an illustration of the pellet stove apparatus 10 indicating the high efficient convection air flow path 48, around the outer surfaces of the fire box 18 and out the convection air outlets 38, 39 and 40. Also is shown humidifier air 50 coming from the vents 46. Ambient room air may circulate through the vents 15 and out the vents 46 with the humidity mixed therein. The humidifier system shall be discussed later.

Figure 3:
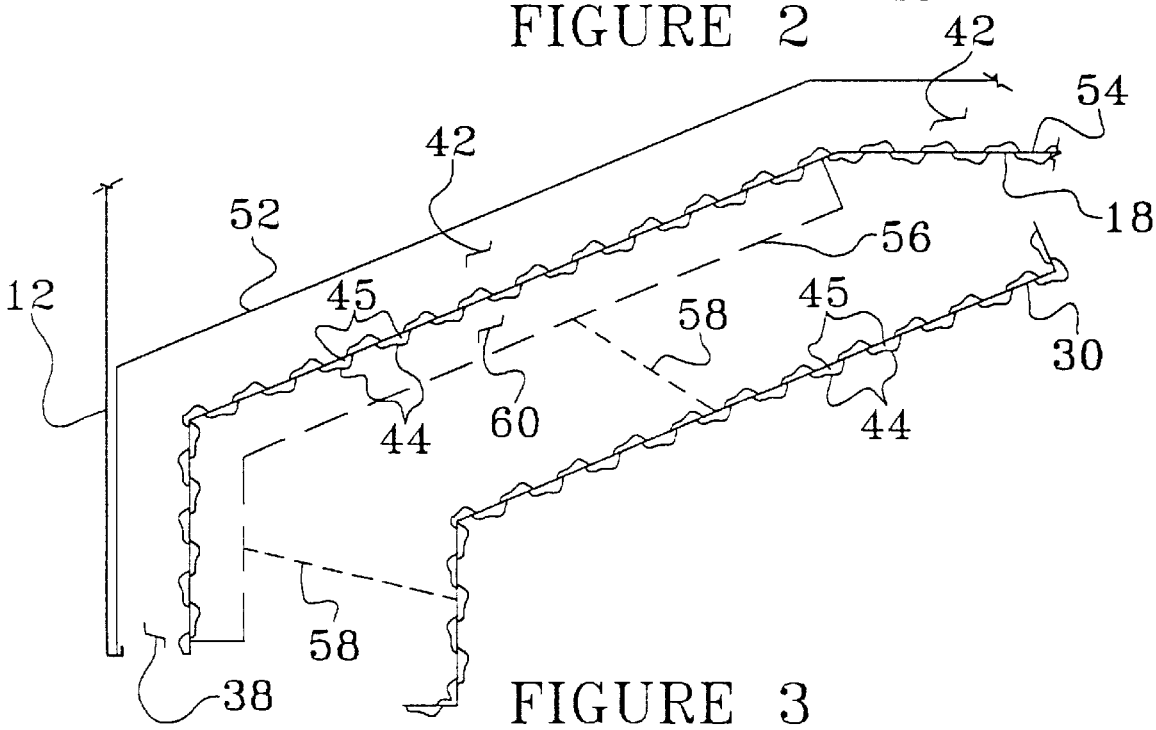
FIG. 3 is a cross-sectional detail view detail showing the dimpled surfaces of the heat exchange system of FIG. 1 and the removable inner panel plate heat exchangers of the present invention.

FIG. 3 discloses the unique dimpled surfaces of the heat exchange system of the present invention. The cross-sectional view details the relationship of the convection air channel 42 between a convection air channel wall 52 and the fire box 18 outer wall 54. Removable inner panel plate heat exchanger 30 replaceably fits into the location/position 56, indicated by dotted lines 58, forming a combustion exhaust gas channel 60. FIG. 3 better shows the dimpling 44 surfaces of the fire box 18 and the removable inner panel 30. Note the reverse side of each dimple 44 is a indentation 45.

The dimpled and indented surfaces 44, and 45 have two functions. Firstly, they provide rigidity to the surfaces which prevents warping caused by temperature changes; and secondly, the dimples and indentations cause turbulence in the air and exhaust gas as they pass through the channels 42 and 60 respectively. These turbulence act to improve heat exchange, e.g., from combustion exhaust gas to dimpled surfaces and from dimpled surfaces to convection air flow.

It is important to understand that the removable inner panel plate heat exchanger 30 can be easily removed without having to remove any screws, bolts or hazardous insulation (as is the case in surfaces of conventional stoves), for easy cleaning and to maintain efficiency by removing residual ashes which may obstruct gas passages. All stoves need to be cleaned from time to time and the present invention provides the easiest and safest possible means to perform such maintenance. The stainless steel dimpled surfaces wipe clean to there original brilliance with just a few strokes of a rag. The panels 30 are reinstalled into the appropriate positions 56 with the same ease as they were removed.

Figure 4:
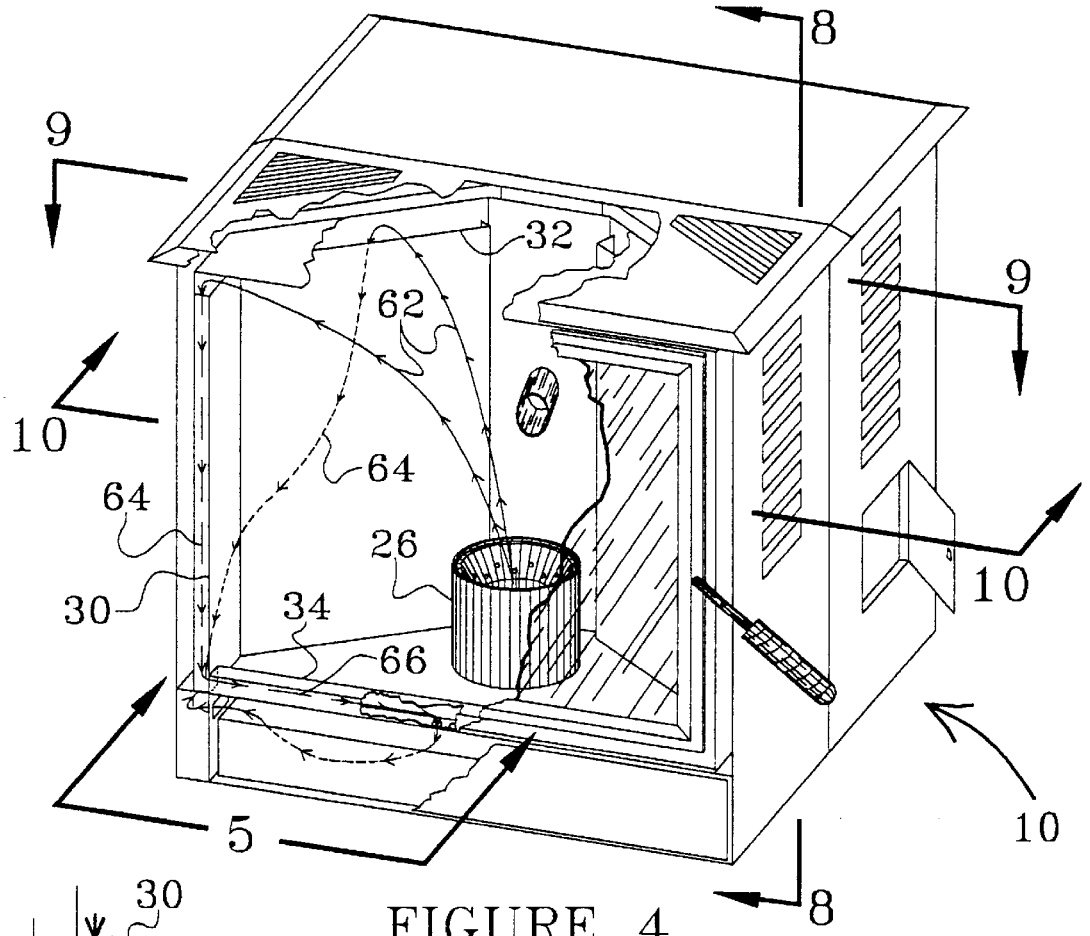
FIG. 4 sets forth a perspective view partially illustrating the combustion gas exhaust path and system structure.

In FIG. 4 is disclosed another perspective view partially illustrating the combustion exhaust gas path. Hot combustion gas and spent pellet fuel ash 62 are forced (as shall be discussed latter) to exit over the upper edge 32 of the removable inner panel plate heat exchangers 30. The exhaust gas and ash 62 continues down the combustion gas channel 60 indicated by path 64 between the panel plate heat exchanger 30 and the outer wall 54 of the fire box 18, and is funneled through the ash direction tube 34 as indicated by path 66.

Figure 5:
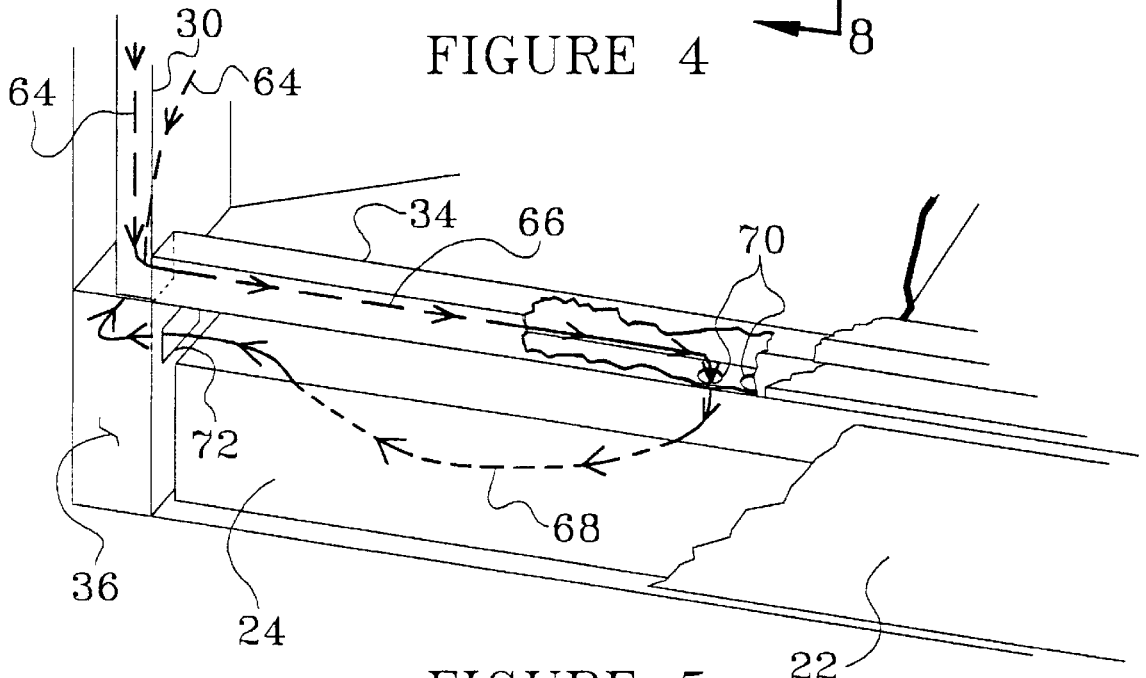
FIG. 5 is a perspective partial view detail of FIG. 4 showing the combustion gas exhaust channeling through the ash pan depositing ashes before evacuating the system.

Refer now to FIG. 5 which details the path of the combustion gas and spent pellet fuel ash as it precedes through the orifices 70 in the center of the ash direction tube 34 into the ash pan 24 behind the ash pan door 22. The spent ash is left in the ash pan 24 as the exhaust gas continues its exit as indicated by path 68 through orifice 72 into the exhaust gas evacuation channel 36 where it is expelled through the back of the apparatus 10 (this process shall be further discussed later).

The importance of the evacuation path of the hot combustion gas and spent pellet fuel ash is key to understanding the present invention. We see that exhaust gas 62 is first forced to the upper most surfaces of the fire box 18 heating the dimpled surfaces of the fire box top 33. Then continues down the channel 60 between dimpled surfaces heating the fire box walls 54 and the removable inner panel plate heat exchanges 30. This configuration allow the most efficient possible extraction of heat from the hot exhaust gas 62 in combination of the convection air flow through the channel 42 which completely surrounds the top and sides of the fire box 18. By the time the exhaust gas 62 reaches the ash pan 24, it is sufficiently cooled and is evacuated out of the system leaving the spent pellet ash within the ash pan 24. Because the exhaust system is a function of controlled force (as shall be more fully discussed later), the heat is dispersed more evenly through out the heat exchange system of dimpled surfaces and is transferred more efficient to the convection air as it passes over the entire fire box top and sides before exiting through the convection air outlets 38, 39 and 40.

Figure 6:
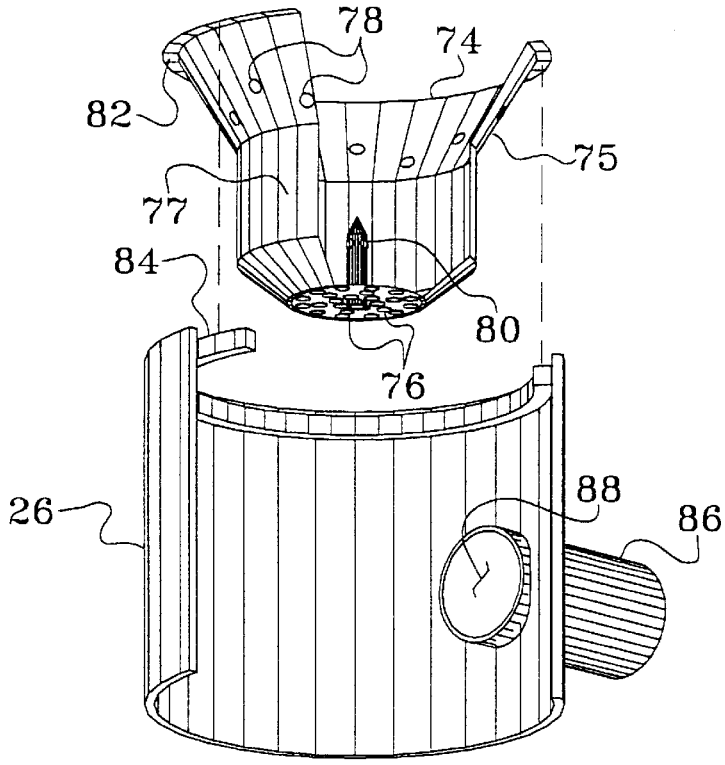
FIG. 6 is an exploded perspective cutaway illustration of the burn pot and low carbon monoxide burn grate assembly of the device of the present invention.

In FIG. 6 is shown an exploded perspective cutaway illustration of the burn pot 26 and a low carbon monoxide burn grate 74. The burn grate 74 has a pit 77 area which is sufficiently large enough to hold fuel pellets to provide the maximum heat output of the stove apparatus 10, yet small enough to maintain a low burn efficiency. In the preferred embodiment the pit 77 is approximately 3 inches in diameter with a depth of 1 and ¾ inches. The low carbon monoxide burn grate 74 has at its base a primary air hole pattern 76 consisting of 26, 3/16 inch holes, and a secondary air pattern 78 consisting of 16 evenly spaced 3/16 inch holes in two offsetting rows of the upper dish area 75.

The burn pot 26 has at its upper lip a grate support 84 and has a combustion air tube 86 connected to its backside providing an air inlet 88. When burn grate 74 is installed into the burn pot 26, the grate rim 82 engages the grate support 84 to form a sufficiently tight seal. The burn grate 74 is removable from the burn pot 26 to facilitate cleaning and maintenance of the system.

Figure 7:
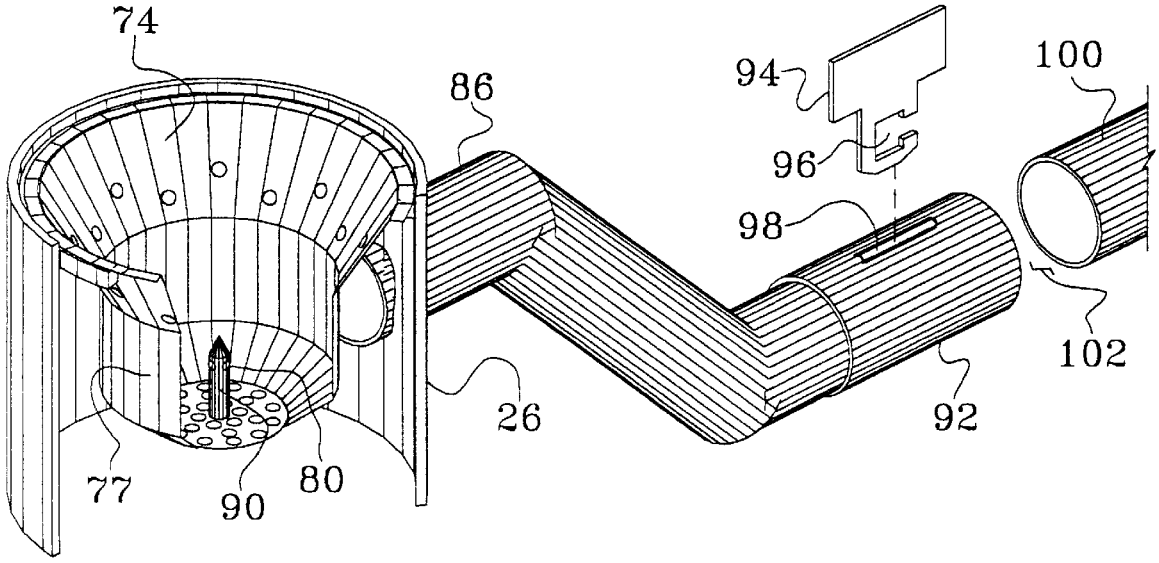
FIG. 7 sets forth the combustion air path of the device of FIG. 6 with combustion air flow sensor electronics and air inlet.

FIG. 7 further discloses the burn pot 26 with the low carbon monoxide burn grate 74 installed. A central low burn core 90 has at its top the previously mention low burn core secondary air holes 80, 4 each ⅛ inch in diameter. The combustion air tube 86 has connected to it, an air flow collar 92. An air flow sensor PCB (printed circuit board) 94 and a mass air flow sensor 96 is shown exploded from the collar 92. Slot 98 shown with dotted line indicates that the flow sensor 96 portion of the PCB 94 would engage into slot so as to have the air flow sensor 96 in the air stream of the air flow collar 92. An air inlet tube 100 provides fresh out side air to the system. There is a space 102 between the fresh air inlet tube 100 and the air flow sensor collar 92 which allows equalization of pressures during operation between ambient outside air and the room inside air where is stove apparatus 10 is located. Air inlet 100 further provides fresh air to flow through the convection air system as shall be discussed latter.

The significance of the combustion air flow through the air flow collar 92 and tube 86 into the burn pot 26 is to control exactly the combustion efficacy of the apparatus 10. Combustion air must flow through the primary air holes 76 and secondary air holes 78. To more efficiently burn the fuel pellets at low levels, the low burn core 90 provides air flow to the center of the pit 77 through core air holes 80, providing combustion air to the "heart" of the flame. This makes even the smallest amount of fuel, to burn hot enough to be combustibly efficient and thus burn clean with low carbon monoxide. It is expressly understood that in the preferred embodiment, a mass air flow sensor is use in the control of combustion air flow providing great sensitivity. However, other means to achieve controlled air flow may be used. Examples of other sensing means may be differential pressure, turbine flow or vortex shedding techniques could be used to gain the same results as with the mass air flow sensor 94 of FIG. 7.

Figure 8:
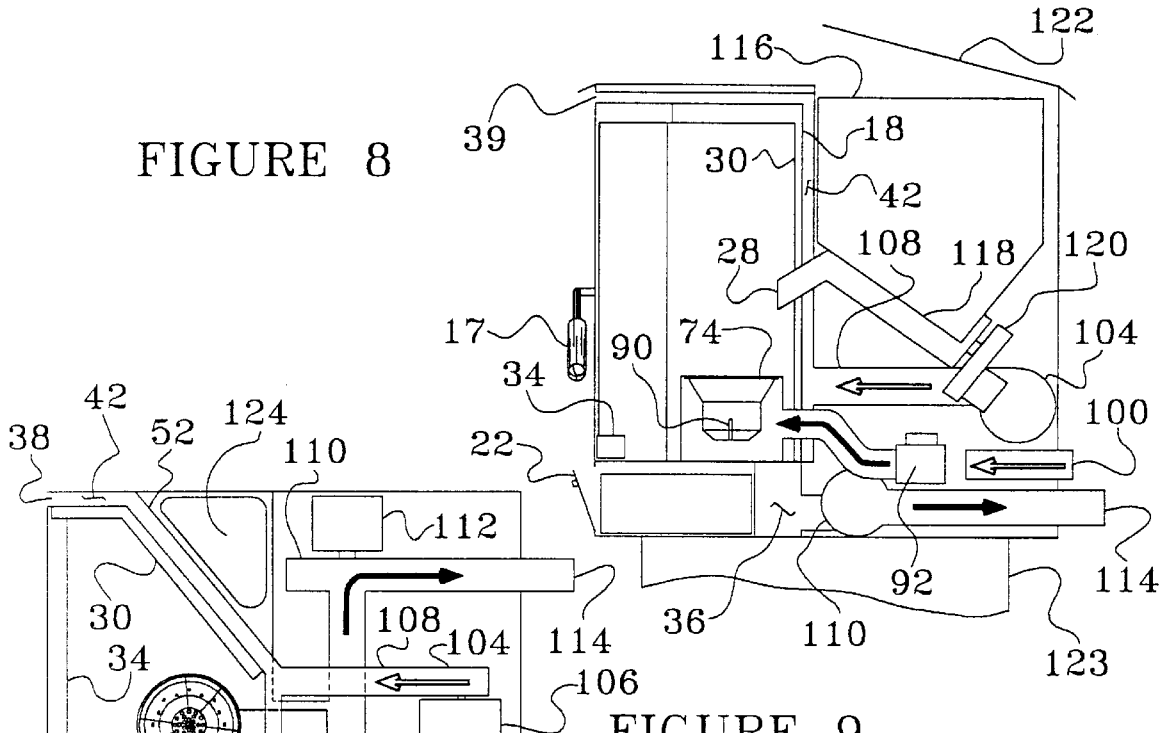
FIG. 8 is a side cross-sectional view of FIG. 4 showing the internal channeling of combustion air, exhaust gas and convection air flow, and the pellet hopper auger feed system.
Figure 9:
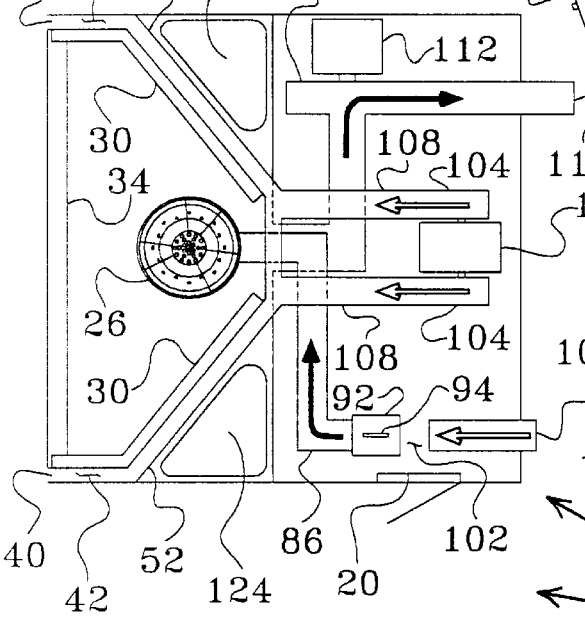
FIG. 9 is a top cross-sectional view of FIG. 4 further showing the internal channeling of combustion air, exhaust gas and convection air flow, and the optional water side tanks of the humidifier system.

FIGS. 8 and 9 are side and top cross-sectional views of FIG. 4 showing the internal channeling of the various passages and tube of the apparatus 10 of the present invention. Convection fans 104 and drive motor 106 pushes air "forced" through manifold 108 which is connected to the convection air channels 42 surrounding the fire box 18. An exhaust fan 110 and drive motor 112 draw combustion air into the air flow collar 92 (where mass air is measured via sensor 96) and through the system where it is evacuated through the exhaust gas channels 36 and pushed out through a exhaust connection 114. The exhaust connection 114 is conventionally connected to a chimney or "through wall" exhaust piping to expel exhaust gas into outside ambient air. A pellet fuel hopper 116 is accessed through a hopper cover 122 which is part of the top panel 13 of the apparatus 10. To feed the fuel pellets an auger 118, driven by an auger motor 120, pushes pellets through auger drop tube 28. The fuel pellets would land into the pit 77 on the burn grate 74 of the burn pot 26. The stove apparatus 10 may be placed, as was earlier mentioned, on a pedestal 123 to elevate the stove off the floor, for example one foot.

FIG. 9 further shows a pair of side water tanks 124 which will hold nearly 2 gallons of water each. Note water tanks are directly behind convection air channel walls 52 and are warned by residual heat as convection air passes through channel 42. The water consequently will evaporate, providing humidified air 50 which is vented out louvered vents 46 as shown in FIG. 2. The water tanks may be replenished in one of two optional ways. 1) by removing vent 46 and manually pouring a quantity of water into the tank 124 or, 2) by connecting a ¼ inch water feed line to a conventional water float and valve system (not shown). The water float, valve and ¼ inch line system are like systems commonly found in refrigerator or ice cube making machines. Also not shown is an optional ¼ inch siphon line between the two tanks 124. This line shall provide an equilibrium of water level between the two tanks providing the replenishing of water to be easier.

Figure 10:
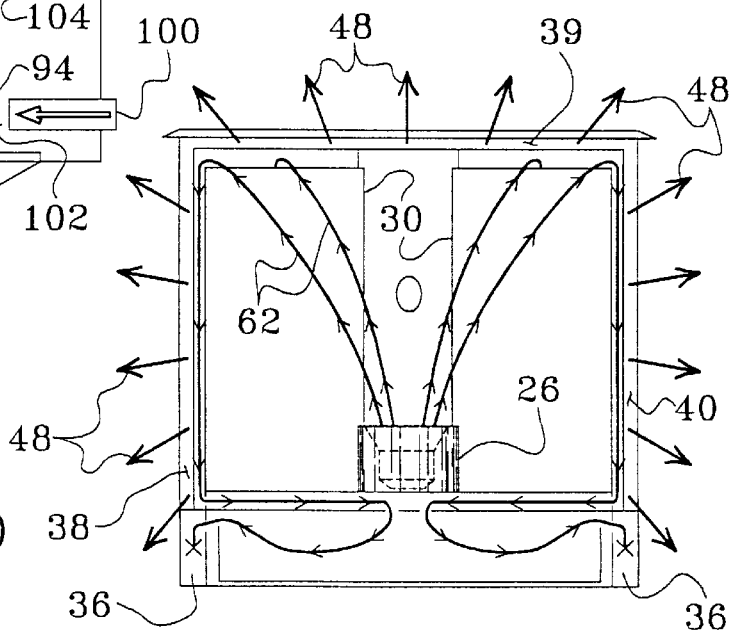
FIG. 10 is a front cross-sectional view of FIG. 4 again showing the unique channeling of combustion exhaust gas and convection air flow.

FIG. 10 is front cross-sectional view of FIG. 4 again showing the unique channeling of combustion exhaust gas 62 passing up, over and behind the panel plate heat exchangers 30 as it is drawn down to the ash direction tube 34 in its evacuation of the system through the exhaust gas evacuation channel 36 passages. And further convection air 48 being forced out of the apparatus 10 as it passes around and over the fire box 18 in the most efficient manner possible.

Figure 11:
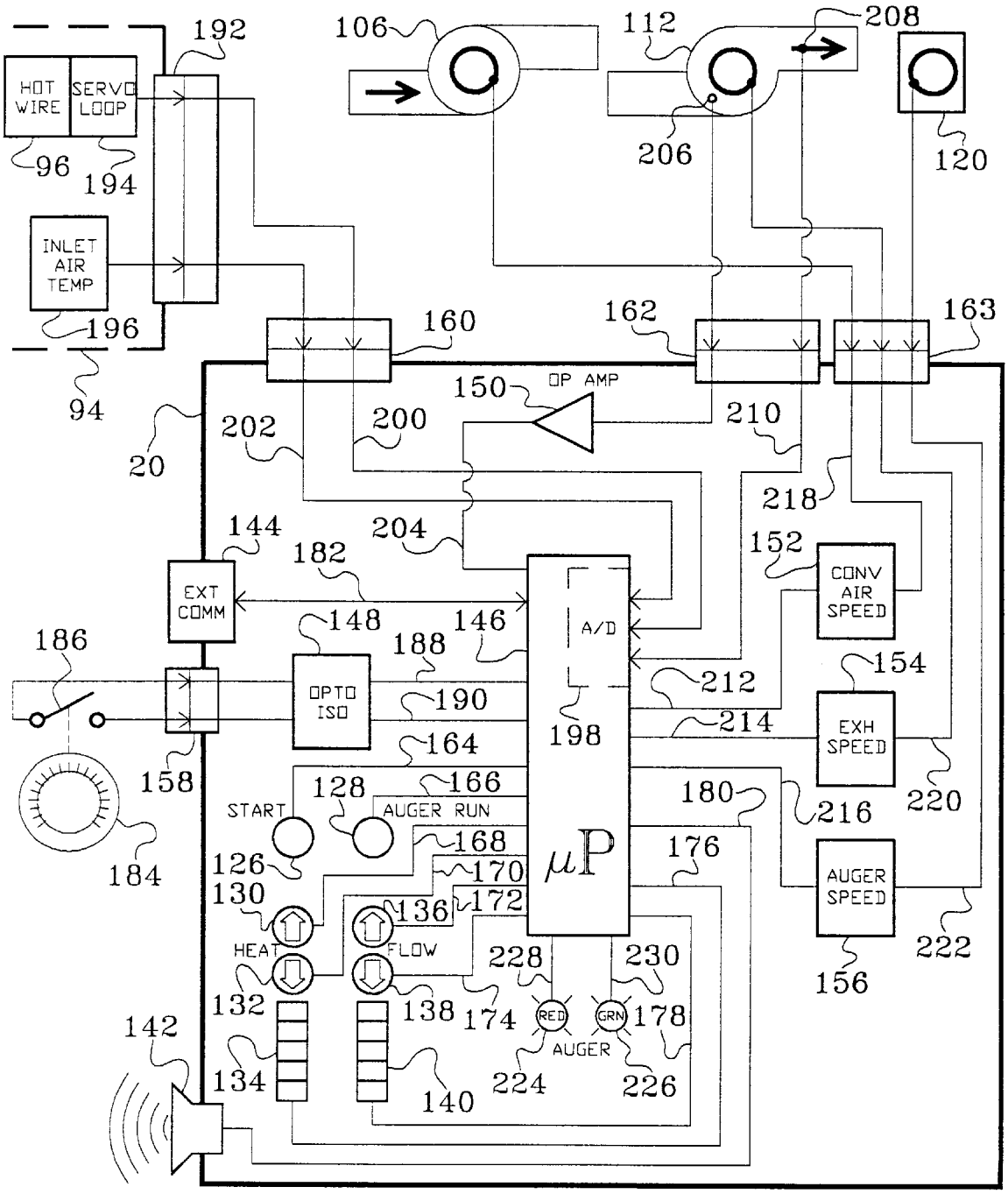
FIG. 11 is a schematic block diagram of the control electronics of the present invention.
Figure 12A:
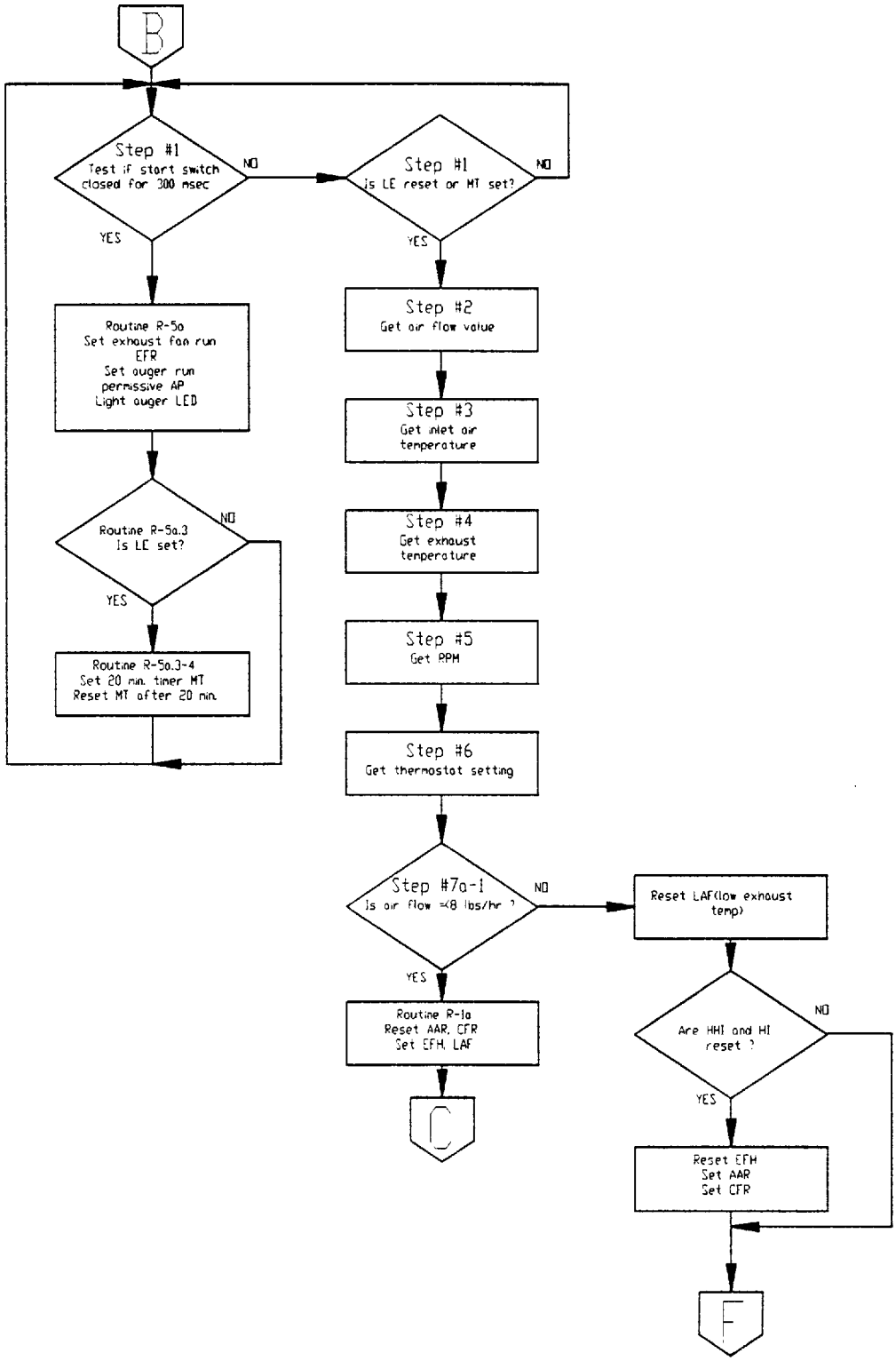
FIGS. 12*a*, 12*b*, 12*c*, 12*d* and 12*e* sets forth a logic flow chart for the control circuit of FIG. 11.
Figure 12B:
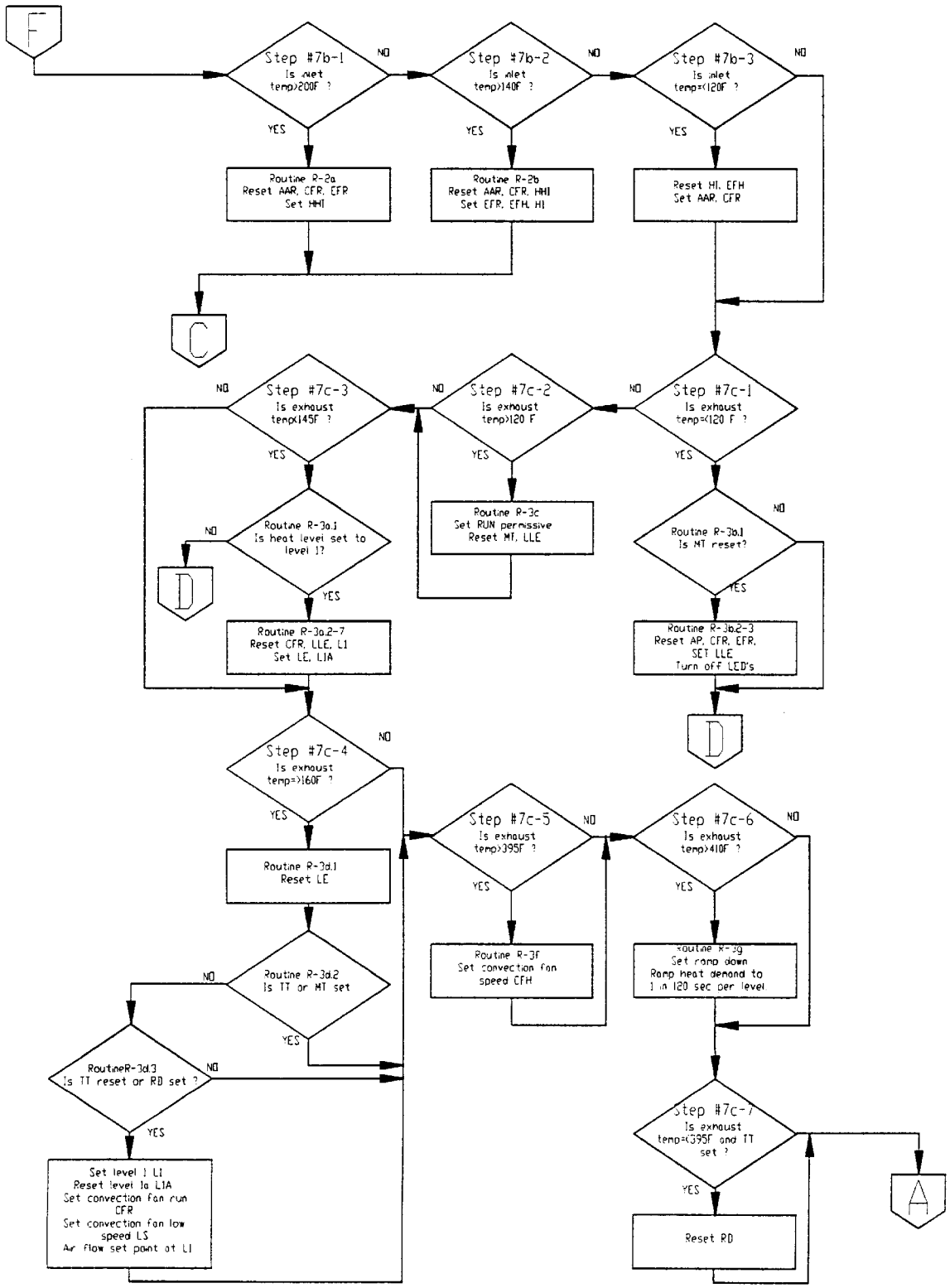
Figure 12C:
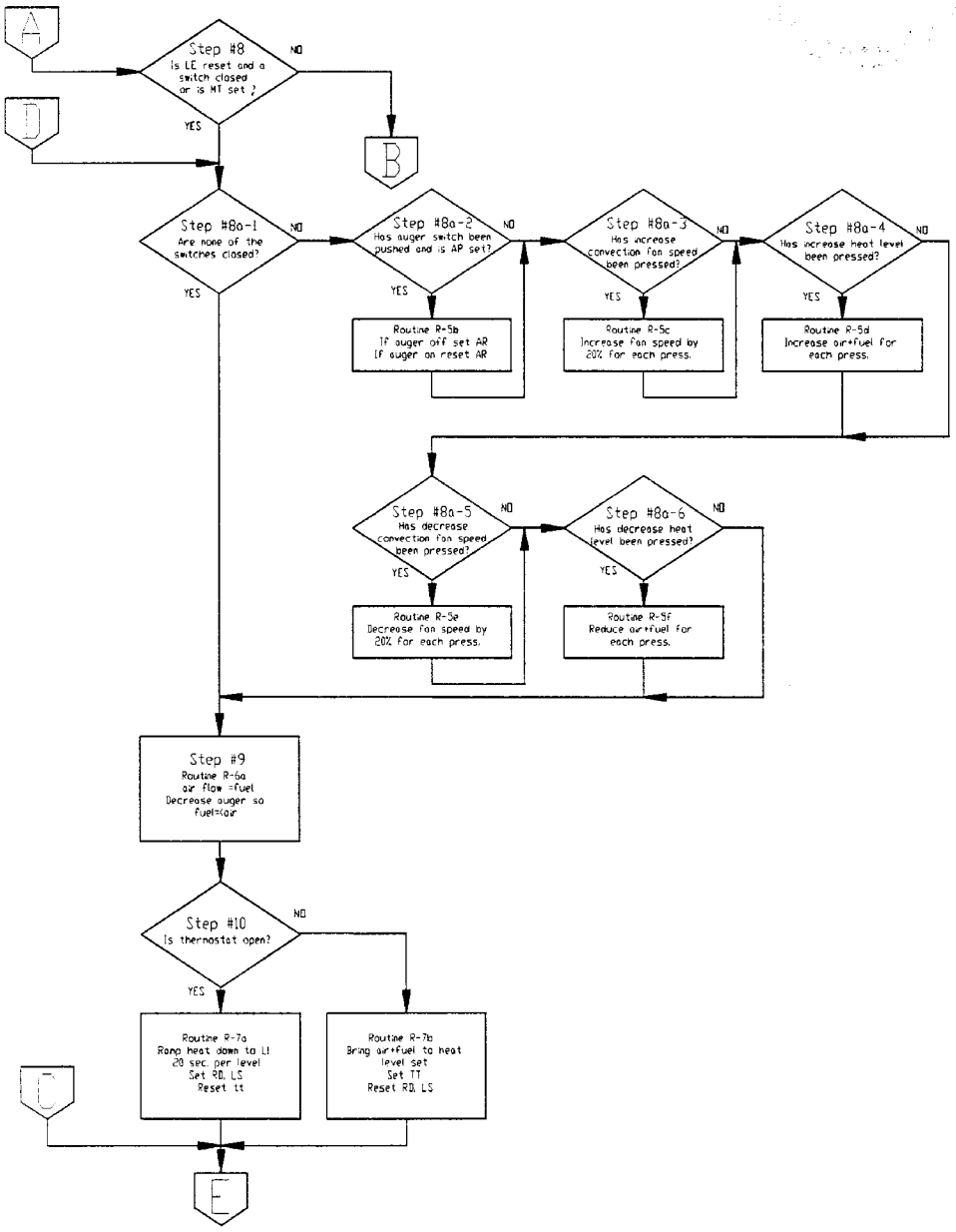
Figure 12D:
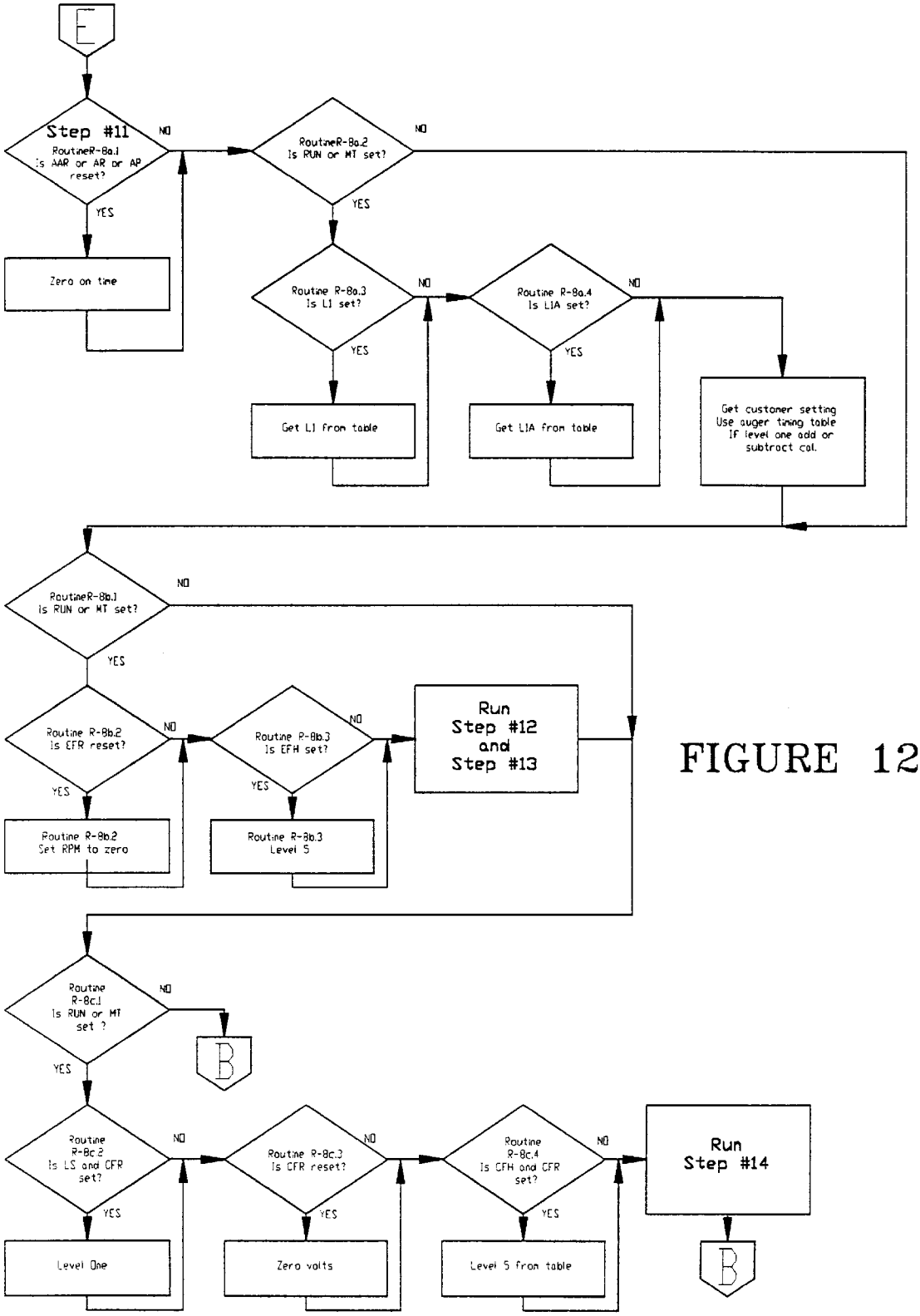
Figure 12E:
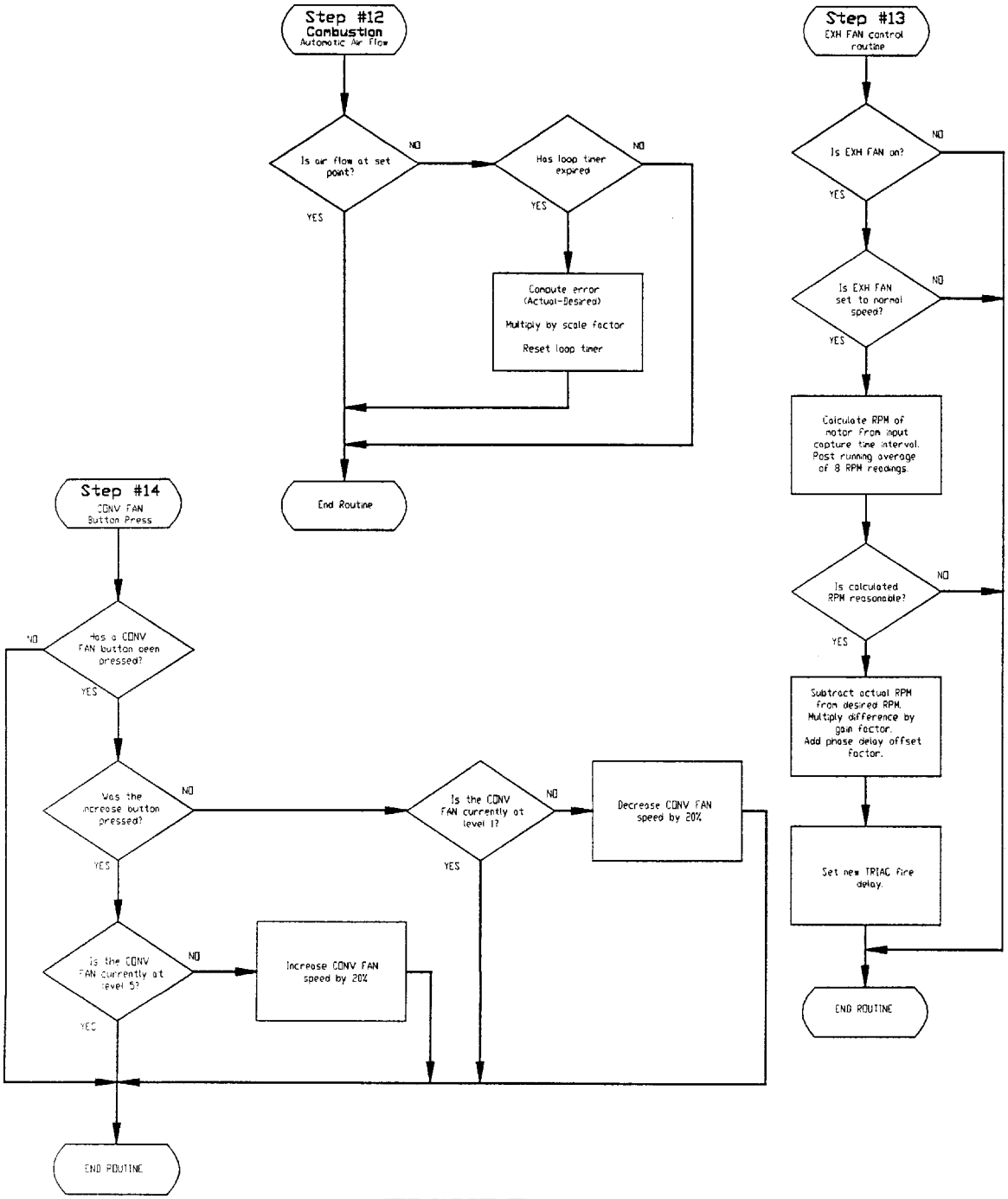

In FIG. 11, is disclosed a schematic block diagram of the control electronics on the control panel 20 as shown on FIG. 1. Control panel 20, on its front side, has a START 126 and AUGER RUN 128 pushbuttons, Also a HEAT INCREASE 130, HEAT DECREASE 132 pushbuttons with light emitting diodes (LED) array 134, and FLOW INCREASE 136, FLOW DECREASE 138 pushbuttons with LED array 140. A audio transducer 142 and external communications jack 144 are also on the front side of the control panel 20. On the back side of the control panel 20 are the electronic components; microprocessor 146, optical isolator 148, operational amplifier 150, electronic 120 volt AC "triac" switches 152, 154 and 156. Also are connectors to the rest of the system via 158, 160, 162 and 163 on the back side of the control panel 20.

START and AUGER RUN switches 126 and 128 are connected to the microprocessor 146 input ports over lines 164 and 166. In like manner, switches 130, 132, 136 and 138 are connected to the microprocessor 146 over lines 168, 170, 172 and 174 respectively to input ports. The arrays 134 and 140, and audio transducer 142 are connected to the microprocessor 146 output ports via lines 176, 178 and 180. The external communications jack 144 is connected to the microprocessor 146 T×D and R×D (transmit data and receive data) ports over bi-directional line 182. There is an integrator/calibrator test instrument (not shown) which connects to the external communications jack 144 and is used to trouble shoot malfunctions and calibrate the stove for field conditions such as, for example, fuel quantity during installation. The test instrument, communicating via the jack 144 is useful also in the manufacturing process validating the various programmed routines (as shall be discussed later) for correctness. The test instrument itself may be a hand held dedicated instrument designed expressly for such functionality or may be a conventional personal computer retrofitted with an appropriate matting connector to communicate via jack 144 and running such diagnostic routines.

Connector 158 is attached to a conventional thermostat 184 with contacts 186. The thermostat contacts 186 is connected to an input port of microprocessor 146 through the optical isolator 148 over lines 188 and 190. The connector 160 mates with the air flow sensor PCB 94 of FIG. 7 via connector 192. The hot wire flow sensor 96 is signal conditioned by a servo loop 194 and is connected to the microprocessor 146 analog to digital (A/D) converter 198 input via line 200. In like manner, a inlet air temperature sensor 196 is connected via connector 192 and 160 over line 202 to the A/D converter 198 of the microprocessor 146. The connector 162 provides further input to the microprocessor from the exhaust fan 110 and motor 112 of FIGS. 8 and 9 via line 204 from a tachometer motor RPM sensor 206 through signal conditioning operational amplifier 150 and into a digital input port of microprocessor 146. And finally, to measure exhaust temperature sensor, a thermistor 208 is connected to an analog input of the A/D converter 198 over line 210.

The last connector 163 provides the 120 volt AC operating current to the three motors in the system. The low-level controlled "triac" devices 152, 154 and 156 require only a microprocessor 146 signal over lines 212, 214 and 216 respectively to activate. To control the speed, each of the motor control devices 152, 154 and 156, and to maintain the desired drive speed of the convection motor 106 over line 218, the exhaust gas motor 112 over line 220 and the auger motor 120 over line 222 by phase pulsing at 60 Hertz, is instructed by the microprocessor.

In operation, the pellet fuel heating stove apparatus 10 is first ignited by depressing the START 126 pushbutton on the control panel 20. If the exhaust temperature as sensed by thermistor 208 is below 125 degrees F., a 20 minute start up timer is initialized as controlled by the microprocessor 146 bypassing the low temperature cutout and thermostat contacts 186. The AUGER GREEN 226 LED illuminates indicating auger control is available and when the AUGER RUN 128 pushbutton is depressed, the AUGER RED 224 LED illuminates and the auger drive motor 120 functions depositing pellet fuel from the hopper 116 out of auger drop tube 28. The pellets land into the pit 77 of the burn grate 74 in burn pot 26 within fire box 18. When the AUGER RUN pushbutton is released, the red LED is extinguished and the drive motor stops. At this time the fuel is conventionally lit by a match or other incendiary device.

The user preset HEAT 134 settings are considered and auger timing to automatically feed 0.7 to 4.0 pounds per hour and, to set the initial exhaust fan speed to balance the air to the fuel as appropriately. The mass air flow, as considered by the FLOW 140 preset setting is used to perform the following: a) accelerate the exhaust fan to full speed if mass air flow drops below 10% air flow, b) turns off the auger feed and convection fan if mass air drops below 10% air flow and, c) trims exhaust fan speed to match air flow rate to fuel feed rate, adjusts air from 14#/hr to 80#/hr or as determined by "testing". Testing is a process that feeds pellet fuel to determine the maximum efficacy (see tables PELLET FEED and AIR FLOW below). The air inlet temperature 196 is considered in the following: a) compensates the mass flow sensor 96 temperature and, b) shuts off the auger and convection fan drive motors when inlet air temperature of 120 degrees F. is sensed and exhaust fan motor is increased to maximum. The exhaust temperature thermistor sensor 208 functions as follows: a) turns off convection fan drive motor and raises fuel/air to 1a level (see tables PELLET FEED and AIR FLOW below) if exhaust temperature drops to 145 degrees fahrenheit., b) turns off all fans and auger if exhaust temperature drops to 120 degrees fahrenheit, c) decrease fuel/air to level 1 if exhaust temperature increases to 160 degrees fahrenheit, d) turns on convection fan to user preset selected speed if exhaust temperature increases to 165 degrees fahrenheit, e) convection fan speed will go to maximum speed at 350 degrees fahrenheit exhaust temperature, f) the heat control ramps to minimum if exhaust temperature reaches 365 degrees fahrenheit and, g) when exhaust temperature decreases to 325 degrees fahrenheit the heat level and convection fan controls return to prior settings. Note, the unit is also equipped with an independent external high temperature limit switch (not shown) to safely shut down the unit as a fail-safe measure.

The thermostat 184 will automatically regulate the stove heat output. This is accomplished when the room temperature is equal to or above the thermostat setting and the contacts 186 opens, The stove apparatus 10 will slowly ramp down to minimum heat output, and the convection air fan 106 goes to a low speed. When the room temperature is lower than the thermostat 184 setting, the contacts 186 close and the stove apparatus 10 ramps up to the user preset HEAT 134 rate and the convection fan 106 goes to user preset FLOW 140 speed.

The exact flow and temperature is determined by a process routine call testing. The following tables are indications of the variables which optimize the fuel combustion of any given scenario.

PELLET FEED

| Heat Position | Lb/Hr | % | Time On | Time Off |
|---|---|---|---|---|
| 1 | 0.7 | 17.5 | 1.0 | 6.14 |
| 1a * | 1.36 | 34.0 | 1.0 | 2.68 |
| 2 | 2.02 | 50.5 | 2.0 | 2.68 |
| 3 | 2.68 | 67.0 | 3.0 | 2.60 |
| 4 | 3.34 | 83.5 | 3.0 | 1.49 |
| 5 | 4.0 | 100.0 | 4.0 | 1.00 |

AIR FLOW

| Heat Position | Lb/Hr | % |
|---|---|---|
| 1 | 14.0 | 17.5 |
| 1a * | 27.2 | 34.0 |
| 2 | 40.0 | 50.5 |
| 3 | 53.6 | 67.0 |
| 4 | 66.0 | 83.5 |
| 5 | 80.0 | 100.0 |

Note The (*) indicated for 1a is used to prevent condensation in the stack at low burn rate The following tables are indicative of motor control settings at various preset selections.

AUGER ADJUSTMENT LEVEL ONE

| 'Y' Seconds | Time Off | Lbs/Hr |
|---|---|---|
| −2.40 | 6.14 + Y | 1.00 |
| −1.26 | 6.14 + Y | 0.85 |
| 0 | 6.14 + Y | 0.70 |
| 0.55 | 6.14 + Y | 0.65 |
| 1.19 | 6.14 + Y | 0.60 |

Y = BIAS
NOTE: ONLY ADJUSTS POSITION ONE

AIR ADJUST

| 'X' Percent | Indicated Air Flow | Actual Air Flow | Exhaust Fan RPM |
|---|---|---|---|
| 10.0% | AF—X | INCREASE | INCREASE |
| 5.0% | AF—X | INCREASE | INCREASE |
| 0.0% | AF—X | NO CHANGE | NO CHANGE |
| −5.0% | AF—X | DECREASE | DECREASE |
| −10.0% | AF—X | DECREASE | DECREASE |

X = BIAS
NOTE: AIR FLOW CAN BE ADJUSTED IN LEVELS 1–5

FIGS. 12*a* through 12*e* sets forth a logic flow chart for the control circuit of FIG. 11 detailing Step #1 through Step #14 of the operating program of the present invention. The following table list the variables used in the flow charts:

| VARIABLE | DESCRIPTION |
|---|---|
| AAR | AUTOMATIC AUGER RUN |
| AP | AUGER PERMISSIVE |
| AR | AUGER RUN |
| CFH | CONVECTION FAN HIGH SPEED |
| CFR | CONVECTION FAN RUN |
| EFH | EXHAUST FAN HIGH SPEED |
| EFR | EXHAUST FAN RUN |
| HHI | HIGH HIGH INLET TEMPERATURE |
| HI | HIGH INLET TEMPERATURE |
| L1 | LEVEL 1 |
| L1A | LEVEL 1a |
| LAF | LOW AIR FLOW |
| LE | LOW EXHAUST TEMPERATURE |
| LLE | LOW LOW EXHAUST TEMPERATURE |

-continued

| VARIABLE | DESCRIPTION |
|---|---|
| LS | CONVECTION FAN LOW SPEED |
| MT | 20 MINUTE TIMER |
| RP | RAMP DOWN |
| RUM | RUN PERMISSIVE |
| TT | THERMOSTAT |

The following is a listing of logical paths expressed as steps:

Step #1

Check stove START 126 switch closed >300 milliseconds

If closed do routine 'R-5a'

If 'LE' temperature is reset or 'MT' is set continue Step 2.

Step #2

Get air flow value

Step #3

Get inlet air temperature

Step #4

Get exhaust temperature

Step #5

Get RPM

Step #6

Get thermostat

Step #7

Check safety conditions a: Low air flow

1. If =<8 lbs/hr do routine 'R-1a'
2. If >8 lbs/hr reset 'LAF' and if 'HHI' and 'HI' are reset than reset 'EFH', set 'AAR' and 'CFR' continue Step 7.b.1 b: High inlet air temperature

1. If >200 degrees F. do routine 'R-2a', else Step 7.b.2
2. If >140 degrees F. do routine 'R-2b', else Step 7.b.3
3. If =<120 degrees F. reset 'HI' and 'EFH', set 'AAR' and 'CFR' continue Step 7.c.1 c: High/low exhaust temperature

1. If =<120 degrees F. do routine 'R-3b', else Step 7.c.2
2. If >120 degrees F. do routine 'R-3c', else Step 7.c.3
3. If <145 degrees F. do routine 'R-3a', else Step 4.c.4
4. If =>160 degrees F. do routine 'R-3d', else Step 7.c.5
5. If >395 degrees F. do routine 'R-3f', else Step 7.c.6
6. If >410 degrees F. do routine 'R-3g', else Step 7.c.7
7. If =<395 degrees F. and 'TT' is set then reset 'RD' continue Step 8.a Step #8

Check for panel setting changes a: If one of the following switch are held closed >300 milliseconds and 'LE' is reset or 'MT' is set then continue Step 8.a.1, else Step 1

1. If no switches are closed continue Step 9.a
2. If AUGER pushbutton is depressed and 'AP' is set, do routine 'R-5b'
3. FLOW INCREASE, do convection fan speed routine 'R-5c'
4. HEAT INCREASE, do heat level routine 'R-5d'
5. FLOW DECREASE, do convection fan speed routine 'R-5e'
6. HEAT DECREASE, do heat level routine 'R-5f'
7. Continue Step 9.a Step #9

Check environmental conditions a: Fuel setting does not exceed air flow routines 'R-7a'

Step #10

Check thermostat condition a: Thermostat open, do routine 'R-7.a' b: Thermostat closed, do routine 'R-7b'

Step #11

Do control algorithms and make necessary field adjustments a: Auger on/off routine 'R-8.a' b: Exhaust fan speed routine 'R-8b' c: Convection fan speed routine 'R-8c'

Step #12

Combustion air control

Step #13

Exhaust fan speed control

Step #14

Convection fan speed control

The following is a listing of routines:

R-1a

1) Reset 'AAR'

2) Reset 'CFR'

3) Set 'EFH'

4) Set 'LAF'

5) Continue Step 11

R-2a

1) Reset 'AAR'

2) Reset 'CFR'

3) Reset 'EFR'

4) Set 'HHI'

5) Continue Step 11

R-2b

1) Reset 'AAR'

2) Reset 'CFR'

3) Set 'EFR'

4) Set 'EFH'

5) Set 'Hi'

6) Reset 'HHi'

7) Continue Step 11

R-3a

1) If HEAT setting is level 1 continue 'R3a.2, else Step 8.a

2) Reset 'CFR'

3) Set 'LE'

4) Reset 'LLE'

5) Air flow to level 1a

6) Set level 'L1A'

7) Reset level 'L1'

8) Continue Step 7.c.4

R-3b

1) If 'MT' is set then continue Step 8.a, else 'R-3.b.2'

2) Reset 'RUN' permissive a. Reset 'AP' b. Reset 'CFR' c. Reset 'EFR' d. Turn 'OFF' all LED's

3) Set 'LLE'

4) Continue Step 8.a

R-3c

1) Set 'RUN' permissive

2) Reset 'MT'

3) Reset 'LLE'

R-3d

1) Reset 'LE'

2) If 'TT' is set or 'MT' is set, continue Step 7.a.5, else routine 'R-3d.3'

3) If 'TT' is reset or 'RD' is set do routine 'R-3d.3.1'
I. Set Level 1 'L1'
II. Reset Level 1a 'L1A'
II. Set Convection Fan Run 'CFR'
III. Set convection fan Low Speed 'LS'
IV. Air flow set point at L1

4) Continue Step 7.c.5

R-3f

1) Set 'CFH'

2) Continue Step 7.c.6

R-3g

1) Set 'RD'

2) Ramp heat demand to level 1 at a rate of 120 seconds for each heat level

3) Continue Step 7.c.6

R-5a

1) Set 'EFR'

2) Set 'Ap', light auger green LED

3) If 'LE' is set then set 20 minute timer 'MT'

4) After 20 minutes reset 'MT' if set

5) Continue Step 1

R-5b

1) If auger is stopped then set 'AR' and continue Step 8.a.3

2) If auger is running then reset 'AR' and continue Step 8.a.3

R-5c

1) Each time 'UP' switch is depressed, increase convection fan speed by 20%

2) Continue Step 8.a.4

R-5d

1) Each time 'UP' switch is depressed, increase air and fuel to match desired heat level over a 20 second period each level change 2) Continue Step 8.a.5

R-5e

1) Each time 'DOWN' switch is depressed, decrease convection fan speed by 20%

2) Continue Step 8.a.6

R-5f

1) Each time 'DOWN' switch is depressed, decrease fuel and air to match desired heat level over a 20 second period each level change.

2) Continue Step 9.a

R-6a

1) % air flow must be =>% fuel

2) Auger timing is decreased so % FUEL is =<% air flow

3) Continue Step 10.a

R-7a

1) Ramp heat level down to level 'L1', 20 seconds each level

2) Set 'RD'

3) Reset 'TT'

4) Set convection fan 'LS'

5) Continue Step 11.a

R-7b

1) Bring air and fuel to user selected heat level at 20 seconds each level

2) Set 'TT'

3) If convection fan is setting '5' and heat setting is '1'then '1a'

4) Reset 'RD'

5) Reset 'LS'

6) Continue Step 11.a

R-8a

1) If 'AAR' or 'AR' is reset then "0 on time", else routine 'R-8a.2'

2) If 'RUN' or 'MT' is set then routine 'R-8a.3, else Step 11.b

3) If 'L1' is set then L1 from table, else 'R-8a.4'

4) If 'L1A' is set then L1a from table, else 'R-8a.5'

5) Get user setting

6) Use auger timing table for timing

7) If level one add or subract calibration value

8) Continue Step 11.b

R-8b

1) If 'RUN' or 'MT' is set then routine 'R-8b.2', else Step 11.c

2) If 'EFR' is reset then 0 RPM, else 'R-8b.2'

3) If 'EFH' is set then level 5, else 'R-8b.4'

4) Calculate Error 'E', subtract Set Point from Air Flow Calibrated

5) Run Step 12

6) Run Step 13

7) Continue Step 11.c

R-8c

1) If 'RUN' or 'MT' is set then routine 'R-8c.2', else continue Step 1

2) If 'LS' is set and 'CFR' is set then level one, else 'R-8c.3'

3) If 'CFR' is reset then 0 volts, else 'R-8c.4'

4) If 'CFH' is set and 'CFR' is set then level 5 from table, else 'R-8c.5'

5) Run Step 14

6) Continue Step 1

It is important to understand that the block diagram circuitry of FIG. 11 and programming logic functions and routines of FIGS. 12*a* through 12*e,* are representative of one method of a desired functionality in the preferred embodiment, and that by those skilled in the art, that equivalent changes in form and detail may be made without departing from the true spirit and scope of the invention as claimed.

While the invention has been particularly described and illustrated in detail with reference to the preferred embodiment, it is expressly understood that modifications and changes may be made thereto and that the present invention is set forth in the following claims.

The embodiments of the invention for which an exclusive privilege and property right is claimed are defined as follows:

1. A wood pellet stove for efficiently burning wood pellets, the stove comprising:

a stove housing having a top, a bottom, a first side panel, a second side panel, a front portion with a fire box access door for providing access into the front portion of said housing and a rear portion;

a fire box with fire box floor disposed in the front portion of said housing, said fire box having fire box walls angled outwardly toward opposite sides of said fire box access door;

a burn pot for burning wood pellets therein and disposed on said fire box floor and centered thereon;

a wood pellet hopper disposed in the rear portion of said housing for holding wood pellets therein and having means for feeding wood pellets into said burn pot;

heat exchanger panels attached to said fire box walls in a spaced relationship forming an combustion air and exhaust gas channel therebetween;

an air inlet space created at a top of said heat exchanger panels for providing an intake for receiving combustion air and exhaust gases into said combustion air and exhaust gas channel between said heat exchanger panels and said fire walls and an air outlet opening for evacuating the gases, said air outlet opening at the bottom of said combustion air and exhaust gas channel and connected to an ash pan chamber disposed below said fire box floor; and a combustion air and exhaust gas fan mounted in the rear portion of said housing for circulating combustion air and exhaust gas from the fire box into and through said combustion air and exhaust gas channel for improved heat exchange.

2. The stove as described in claim 1 wherein said heat exchanger panels and said fire box walls are dimpled for creating turbulence in the combustion air and exhaust gas and improved heat exchange.

3. The stove as described in claim 1 wherein said heat exchanger panels are removably attached to said fire box walls for ease in cleaning.

4. The stove as described in claim 1 further including an ash pan disposed in said ash pan chamber and an ash pan door in the front portion of said housing for providing access to said ash pan.

5. The stove as described in claim 1 further including a convection air space disposed between the top of said housing and a top of said fire box walls and convection air spaces between the first and second side panels of said housing and said fire box walls, said convection air spaces having openings in the front portion of said housing for discharging heated convection air outwardly from the stove and a convection air fan mounted in the rear portion of said housing and connected to said convection air spaces for circulating air therethrough.

6. A wood pellet stove for efficiently burning wood pellets, the stove comprising:

a stove housing having a top, a bottom, a first side panel, a second side panel, a front portion with a fire box access door for providing access into the front portion of said housing and a rear portion;

a fire box with fire box floor disposed in the front portion of said housing, said fire box having fire box walls angled outwardly toward opposite sides of said fire box access door;

an annular shaped burn pot disposed on said fire box floor and centered thereon, said burn pot having a burn grate and pit for burning wood pellets therein, said pit sufficient in size for holding enough pellets to provide maximum heat output of the stove yet small enough to maintain a low burn efficiency, said burn grate received on top of said burn pot;

a wood pellet hopper disposed in the rear portion of said housing for holding wood pellets therein and having means for feeding wood pellets into said burn pot; and a hollow low burn core extending upwardly from a center of said pit, the burn core have spaced apart holes therein for providing combustion air to the center of said pit and thereby providing more efficient burning of the wood pellets at low levels.

7. The stove as described in claim 6 further including a plurality of spaced apart holes in said burn grate and pit for circulating combustion air into said burn pot and pit.

8. The stove as described in claim 7 further including a air inlet tube for receiving combustion air therethrough, said air inlet tube having one end received through the side of said burn pot for introducing combustion air into said burn grate and pit.

9. The stove as described in claim 8 further including an air flow sensor mounted in said air inlet tube for monitoring the amount of combustion air received through said air inlet tube and into said burn pot.

10. A wood pellet stove for efficiently burning wood pellets, the stove comprising:

a stove housing having a top, a bottom, a first side panel, a second side panel, a front portion with a fire box access door for providing access into the front portion of said housing and a rear portion;

a fire box with fire box floor disposed in the front portion of said housing, said fire box having fire box walls angled outwardly toward opposite sides of said fire box access door;

a burn pot for burning wood pellets therein and disposed on a fire box floor and centered thereon;

a wood pellet hopper disposed in the rear portion of said housing for holding wood pellets therein and having means for feeding wood pellets into said burn pot;

a control panel mounted on said housing and having a microprocessor;

an air and exhaust gas fan mounted in the rear portion of said housing, said microprocessor electrically connected to said combustion air and exhaust gas fan for regulating the amount of combustion air circulated through said housing;

an air flow sensor mounted in an air inlet tube received in said housing for sensing the amount of combustion air introduced into said housing, said microprocessor electrically connected to said air flow sensor for monitoring the amount of combustion air received through said air inlet tube; and a exhaust gas temperature sensing means connected to said convection air fan and connected to said microprocessor for sensing exhaust gas temperature exiting said housing and controlling the operation of said convection air fan.

11. The stove as described in claim 10 wherein said microprocessor is electrically connected to said means for feeding wood pellets into said burn pot for regulating the amount of feed of the wood pellets.

12. The stove as described in claim 10 further including an convection air fan mounted in the rear portion of said housing, said microprocessor electrically connected to said convection air fan for regulating the amount of convection air circulated through said housing.

13. The stove as described in claim 10 further including a air temperature sensing means mounted in said air inlet tube and connected to said microprocessor and said air flow sensor for monitoring inlet air temperature coming into said housing.

14. The stove as described in claim 10 further including a exhaust gas temperature sensing means connected to said convection air fan and connected to said microprocessor for sensing exhaust gas temperature exiting said housing and controlling the operation of said convection air fan.

15. The stove as described in claim 10 wherein said exhaust gas temperature sensing means automatically shuts down said means for feeding wood pellets and said convection air fan if the exhaust temperature of the stove falls below a predetermined temperature.

16. The stove as described in claim 10 further including a thermostat connected to said microprocessor for automatically regulating heat output of the stove.

17. The stove as described in claim 10 further including heat increase pushbuttons and heat decrease pushbuttons mounted in said control panel and connected to said microprocessor for increasing and decreasing heat output of the stove.

* * * * *